United States Patent [19]

Ward

[11] Patent Number: 4,616,862

[45] Date of Patent: Oct. 14, 1986

[54] ELECTRICALLY CONTROLLED DOOR LOCKING SYSTEM

[75] Inventor: Marcus J. S. Ward, Billericay, United Kingdom

[73] Assignee: Ford Motor Company, Dearborn, Mich.

[21] Appl. No.: 754,806

[22] Filed: Jul. 12, 1985

[30] Foreign Application Priority Data

Jul. 14, 1984 [GB] United Kingdom ..... 8417983

[51] Int. Cl.[4] ..... E05C 3/26; E05B 5/00

[52] U.S. Cl. ..... 292/201; 292/336.3; 292/DIG. 27; 292/DIG. 31

[58] Field of Search ..... 292/201, 216, 336.3, 292/144, DIG. 27, DIG. 31, DIG. 37; 60/542, 544

[56] References Cited

U.S. PATENT DOCUMENTS

| | | | |
|---|---|---|---|
| 3,036,453 | 5/1962 | Dubonnett | 292/DIG. 37 X |
| 3,113,447 | 12/1963 | Oishei | 292/144 X |
| 3,481,076 | 12/1969 | Bedard | 49/2 X |
| 3,501,187 | 3/1970 | Saksa et al. | 292/1 |
| 3,971,241 | 7/1976 | Parsson | 292/201 X |

*Primary Examiner*—Alexander Grosz
*Assistant Examiner*—Russell W. Illich
*Attorney, Agent, or Firm*—Daniel M. Stock; Clifford L. Sadler

[57] ABSTRACT

A vehicle door locking system uses a simple latch mechanism (10) without internal locking means connected to an external door handle (28) through a collapsible bellows (32). A solenoid controlled valve (44), when open, vents the bellows to atmosphere, allowing the bellows to collapse and transmit no movement from the door handle to the latch mechanism or, when closed, presents collapse of the bellows, which then transmits movement of the door handle to the latch mechanism.

14 Claims, 4 Drawing Figures

ELECTRICALLY CONTROLLED DOOR LOCKING SYSTEM

BACKGROUND OF THE INVENTION

1. Field of Invention

This invention relates to a vehicle locking system in which the locking and unlocking of a door against opening from the outside is effected by electrically controlled means. The system of the invention is of the type suitable for central control to provide for locking and unlocking of all doors by one operation.

2. Description of the Prior Art

Prior art systems using solenoid or vacuum actuation are well known. The majority of such systems and an actuator to existing mechanical locking systems. The present invention provides a lost cost solution to central control by using simplified latches and a new form of electrically controllable connection between the outside door handle and latch mechanism.

SUMMARY OF THE INVENTION

According to the present invention, there is provided a vehicle door locking system comprising a door latch mechanism and an outside door handle mounted on a vehicle door. The handle is connected to the latch mechanism by means including a pneumatic bellows having an electrically actuated valve. The bellows is sealed when the valve is closed to transmit movement of the handle to the latch mechanism and the bellows is deflated by movement of the handle when the valve is open without transmitting handle movement of the latch mechanism.

BRIEF DESCRIPTION OF THE DRAWINGS

The invention will now be described, by way of example, with reference to the accompanying drawings, in which.

DESCRIPTION OF A PREFERRED EMBODIMENT

Figure 1:
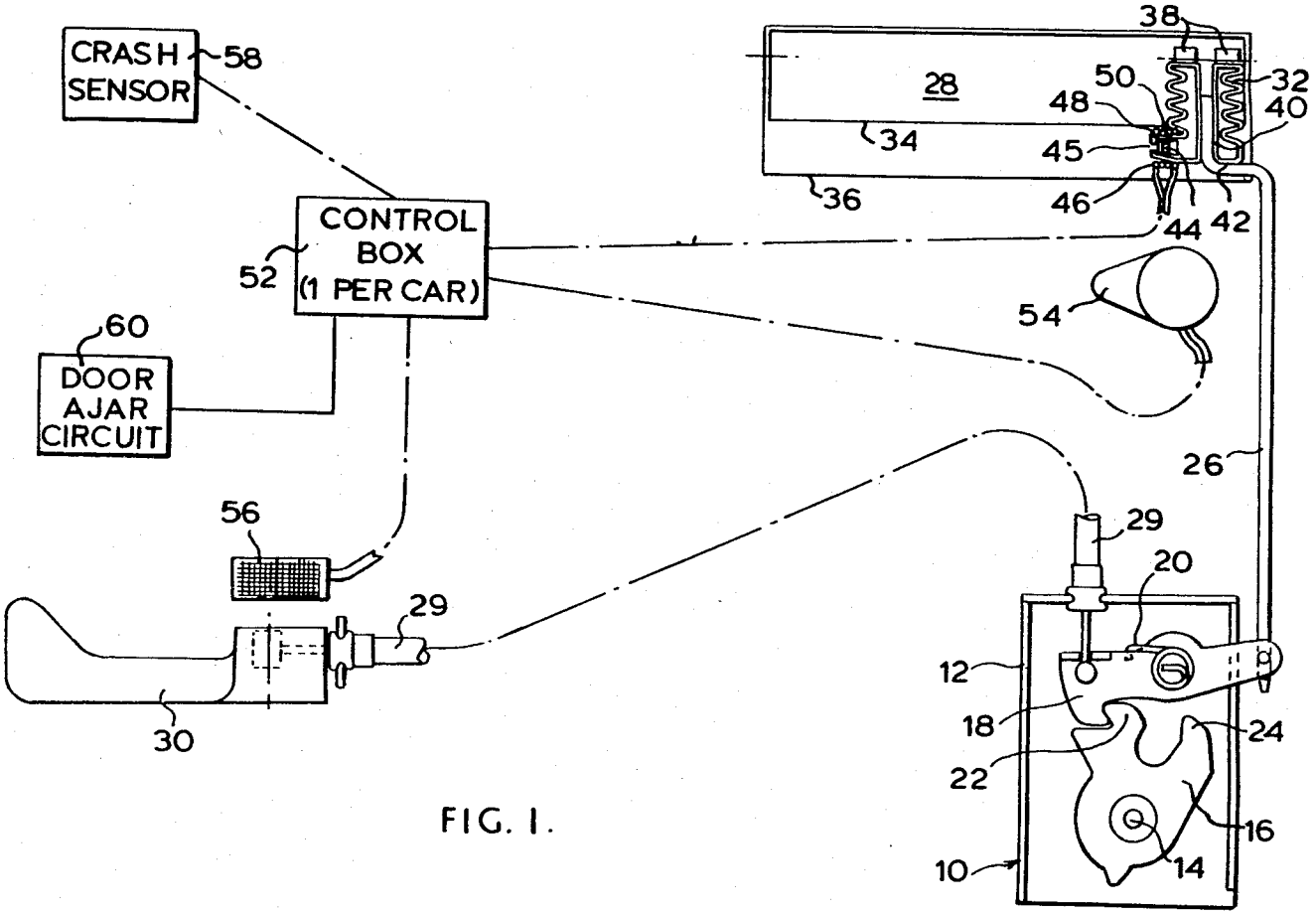
FIG. 1 is a diagram of a vehicle door locking system embodying the invention.

In a vehicle having the door locking system of the invention, each door has a latch mechanism 10 comprising a housing 12, a shaft 14 on which is mounted, externally of the door, a bifurcated keeper member (not shown), and internally of the door a ratchet member 16. A pawl 18 is pivotally mounted on the housing and biassed into engagement with the ratchet member 16 by a coil spring 20. The pawl 18 cooperates with teeth 22 and 24 on the ratchet member 16 to define fully closed and partially closed positions of the door.

The outer end of the pawl 18 is connected by a rod 26 to an outside door handle 28 and the inner end of the pawl 18 is connected by a Bowden control cable 29 to an inside door handle 30. It should be noted that the latch mechanism has no internal locking lever for preventing release of the latch from the outside door handle when the door is locked. This function is provided by a bellows 32 in the outside door handle 28.

The outside door handle 28 includes an elongated finger pull member 34 pivotally mounted on a housing 36 for movement about a horizontal axis. A bifurcated lever 38 fixed to one end of the finger pull member 34 engages the upper end of the bellows 32.

The bellows 32 is of cylindrical shape with an axial recess 40 at the lower end which receives the upper end of the rod 26. The rod 26 is cranked at its upper end to provide a shoulder 42 for driving engagement by the lower end of the bellows 32.

A valve 44 vents the bellows to atmosphere through aperture 45. A solenoid 46, when energized, drives a soft iron valve member 48, within the bellows, towards the end of valve body 50 to close the aperture 45 and seal the bellows 32.

Figure 2A:
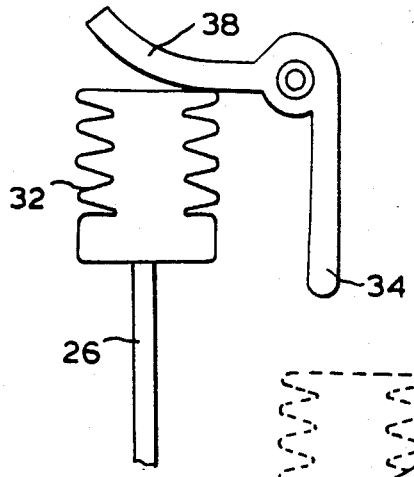
FIGS. 2A, 2B and 2C show the bellows in different operating conditions.
Figure 2B:
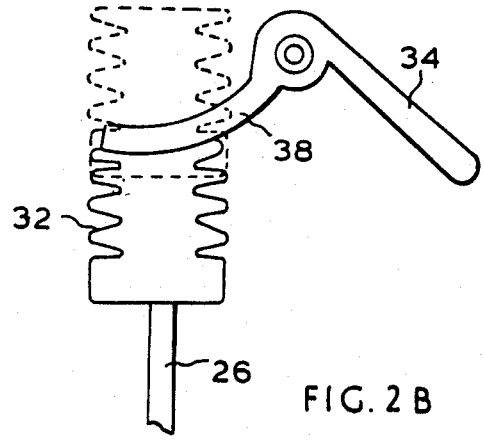
Figure 2C:
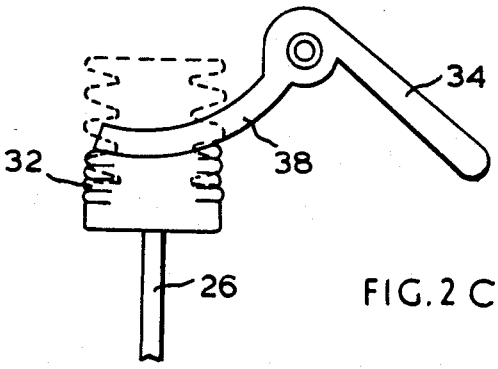

Referring to FIGS. 2A and 2C, the bellows 32 is shown in FIG. 2A in the inflated condition which it normally assumes between the lever 38 and the rod 26. Operation of the outside door handle 28 when the valve 44 is open causes the bellows 32 to collapse (to the FIG. 2C condition) since it is compressed between lever 38 and rod 26 and the air it contains is free to escape through the open valve 44. Thus, the door is locked against being opened from the outside when the valve 44 is open.

Operation of the outside door handle when the valve 44 is closed creates a build-up of pressure in the bellows 32 sufficient to displace the rod 26 and release the latch mechanism 10 (see FIG. 2B). Thus, the door is unlocked when the valve 44 is closed.

A similar arrangement may be used for the latch mechanism of the vehicle deck lid or tailgate.

The solenoid coils 45 of the valves 44 in each door and the deck lid/tailgate are connected to a central control box 52. Each front door has an external key cylinder switch 54 connected to the control box 52 and each door (including the rear doors but not the desk lid/tailgate) has a rocker switch 56 connected to the control box and operable to send a "lock" or "unlock" signal to the control box.

The control box operates as follows:

(a) locking movement of the key cylinder switch 54 on the driver's door switches off energization of all the valves 44 to lock all doors;

(b) unlocking movement of the key cylinder switch 54 on the driver's door energizes all the valves 44 to unlock all doors;

(c) opening of any door is detected by closing of its related door ajar switch 60 and results in energization of all valves 44 to unlock all doors;

(d) operation of the rocker switch 56 on the driver's door has the same effect as operation of the key cylinder switch 54;

(e) operation of the key cylinder switch 54 on the front passenger door energizes or switches off energization only of the valve 44 of that door; and (f) operation of the rocker switch 56 of any door other than the driver's door energizes or switches off energization of only the valve 44 of that door.

The control box 52 may be connected to a crash sensor 58 and arranged to energize all valves 44 and unlock all doors in the event of a crash.

What is claimed is:

1. A vehicle door locking system comprising a door latch mechanism and an outside door handle mounted on a vehicle door, characterized in that the handle is connected to the latch mechanism by means including a pneumatic bellows having an electrically actuated valve, the bellows being sealed when the valve is closed to transmit movement of the handle to the latch mechanism and the bellows being deflated by movement of the handle when the valve is open without transmitting handle movement to the latch mechanism.

2. A vehicle door locking system as defined in claim 1, characterized in that the bellows has an axial recess to receive one end of a rod connected to the latch mechanism.

3. A vehicle door locking system as defined in claim 2, characterized in that a lever movable with the handle rests against the end of the bellows remote from the rod.

4. A vehicle door locking system as defined in claims 1, 2, or 3, characterized in that the electrically actuated valve is a solenoid with a soft iron core forming a valve member within the bellows.

5. A vehicle door locking system as defined in claim 4, in which the valve is normally open and is closed when energized.

6. A vehicle door locking system as defined in claim 5, characterized in that the latch mechanism has no internal locking mechanism and locking of the door is provided solely by venting of the bellows to disable the connection between the handle and the latch mechanism.

7. A vehicle door locking system as defined in claim 4, characterized in that the latch mechanism has no internal locking mechanism and locking of the door is provided solely by venting of the bellows to disable the connection between the handle and the latch mechanism.

8. A vehicle door locking system as defined in claims 1, 2 or 3, characterized in that the latch mechanism has no internal locking mechanism and locking of the door is provided solely by venting of the bellows to disable the connection between the handle and the latch mechanism.

9. A vehicle door locking system as defined in claim 8 in which an internal door handle is connected to the latch mechanism and is operable to release the latch irrespective of actuation of the valve, characterized in that an electrical switch is provided on the inside of the door operable to energize or stop energization of the valve to unlock or lock the door from the inside.

10. A vehicle door locking system as claimed in claim 8 in which opening of the door is detected by a door ajar circuit, characterized in that the valve is energized to unlock the door upon detection of a door ajar condition by the door ajar circuit.

11. A vehicle door locking system comprising a plurality of doors having locking systems as defined in claim 8, characterized in that central control means are provided, responsive to switch means in one of the doors to energize or discontinue energization of the valves of the bellows in all of the doors.

12. A vehicle door locking system as defined in claim 1 in which an internal door handle is connected to the latch mechanism and is operable to release the latch irrespective of actuation of the valve, characterized in that an electrical switch is provided on the inside of the door operable to energize or stop energization of the valve to unlock or lock the door from the inside.

13. A vehicle door locking system as claimed in claims 1 or 12 in which opening of the door is detected by a door ajar circuit, characterized in that the valve is energized to unlock the door upon detection of a door ajar condition by the door ajar circuit.

14. A vehicle door locking system comprising a plurality of doors having locking systems as defined in claims 1 or 12, characterized in that central control means are provided, responsive to switch means in one of the doors to energize or discontinue energization of the valves of the bellows in all of the doors.

* * * * *